US005088940A

United States Patent [19]

Saito

[11] Patent Number: 5,088,940

[45] Date of Patent: Feb. 18, 1992

[54] ELECTRICAL JUNCTION DEVICE

[75] Inventor: Takahiro Saito, Kosai, Japan

[73] Assignee: Yazaki Corporation, Tokyo, Japan

[21] Appl. No.: 596,187

[22] Filed: Oct. 12, 1990

[30] Foreign Application Priority Data

Oct. 24, 1989 [JP] Japan ..... 1-123588[U]

[51] Int. Cl.[5] ..... H01R 13/68

[52] U.S. Cl. ..... 439/621; 439/723

[58] Field of Search ..... 439/621, 622, 721, 722, 439/723, 724, 110, 214; 337/187-189, 191-193

[56] References Cited

U.S. PATENT DOCUMENTS 3,720,907 3/1973 Asick ..... 439/747
4,722,701 2/1988 Bradt ..... 439/718

FOREIGN PATENT DOCUMENTS 59-28989 2/1984 Japan .
64-19259 1/1989 Japan .
64-19260 1/1989 Japan .

*Primary Examiner*—Gary F. Paumen
*Attorney, Agent, or Firm*—Armstrong, Nikaido, Marmelstein, Kubovcik & Murray

[57] ABSTRACT

An electrical junction device including an electrical insulating housing having a plurality of terminal receiving chambers partitioned by a plurality of first partition walls. The device also includes a joint terminal member having a common base, a plurality of terminals adapted to be connected to mating terminals and extending from the common base, and a connecting portion formed in the common base and adapted to be connected to an external wire. The terminals of the joint terminal member are received in the terminal receiving chambers of the housing, respectively. A connecting portion receiving chamber having an opening is formed in the housing so as to be partitioned from the terminal receiving chambers by a second partition wall. A plurality of slits are formed in the partition walls for permitting insertion of the joint terminal member. A common base receiving portion is formed in each of the terminal receiving chambers so as to be communicated with the slits. The common base receiving portion has a bottom wall adapted to abut against the common base upon insertion of the joint terminal member into the slits. The connecting portion is formed by bending the common base to be exposed to the opening of the connecting portion receiving chamber. This structure allows the connection between the joint terminal member and the external wire to be carried out irrespective of the timing of mounting the electrical junction device to a vehicle, the joint terminal member is prevented from being detached from the housing upon insertion of the mating terminals, and, the structure of the device is simplified.

5 Claims, 6 Drawing Sheets

ELECTRICAL JUNCTION DEVICE

BACKGROUND OF THE INVENTION

The present invention relates to an electrical junction box such as a fuse box, and more particularly to an electrical junction device having a terminal receiving chamber for receiving a joint terminal member formed with a conductive common base and a plurality of tab terminals extending from the common base.

In an electrical junction device such as a fuse box for connecting a plurality of terminals with each other, a group of the terminals has the same potential. Such terminals having the same potential are formed from a joint terminal member formed with a common base and a plurality of comb-like tab terminals extending from the common base.

FIG. 8 shows a conventional electrical junction device using such a joint terminal member. Referring to FIG. 8, reference numeral 1 designates an electrical insulating housing having a plurality of terminal receiving chambers 2 partitioned by a plurality of partition walls 3. A joint terminal member 4 is adapted to be inserted into the terminal receiving chambers 2 from a lower side of the housing 1 and locked in the terminal receiving chambers 2. The joint terminal member 4 is formed with a common base 4*a* and a plurality of tab terminals 4*b* extending upwardly from the common base 4*a*. The number of the tab terminals 4*b* corresponds to the number of the terminal receiving chambers 2. When the joint terminal member 4 is inserted and locked in the housing 1, the common base 4*a* of the joint terminal member 4 is inserted between an outer wall 1*a* of the housing 1 and a connecting portion 5 of the housing 1 so as to align a bolt hole 4*c* formed through the common base 4*a* with a female threaded hole 5*a* formed in the connecting portion 5. Then, a bolt hole 6*a* of a terminal 6 of an external wire is aligned with the bolt hole 4*c* of the common base 4*a*, and a bolt 7 is inserted through the bolt holes 6*a* and 4*c* into the female threaded hole 5*a*, thus connecting the terminal 6 to the joint terminal member 4 by fastening the bolt 7. Further, the joint terminal member 4 is formed with a plurality of lock holes 4*d* corresponding to the tab terminals 4*b*. As shown in FIG. 9, a lance 8 is formed in each of the terminal receiving chambers 2, so that a locking end of the lance 8 may be engaged with the corresponding lock hole 4*d* of the joint terminal member 4 when the joint terminal member 4 is inserted into the housing 1.

On the other hand, a plurality of independent male terminals 9 are adapted to be inserted into the terminal receiving chambers 2 from the lower side of the housing 1 and locked in the terminal receiving chambers 2 under the condition where the male terminals 9 are opposed to the tab terminals 4*b*, and are electrically insulated to tab terminals 4*b*. Electrical wires (not shown) from electrical parts are connected to lower ends of the male terminals 9.

A fusible link 11 having female terminals as mating terminals 10 are connected to each tab terminal 4*b* and each male terminal 9 from an upper side of the housing 1. Thus, an electrical junction device A is constructed.

In the above-mentioned electrical junction device A, the joint terminal member 4 is inserted into the housing 1 from the lower side thereof, and the terminal 6 of the external wire is mounted from a side surface of the housing 1. Accordingly, after mounting the electrical junction device A at a given position in a vehicle or the like, the terminal 6 cannot be connected unless a sufficient working space around the electrical junction device A is ensured. Normally, since such a working space cannot be ensured, the timeframe during which terminal 6 can be mounted is actually limited.

Furthermore, as an insert direction of the mating terminals 10 of the fusible link 11 is the same as a detachment direction of the joint terminal member 4, there is a possibility that the joint terminal member 4 is detached under a depression force applied from the fusible link 11 upon insertion thereof. To eliminate such a problem, the lance 8 needs to be formed in each of the terminal receiving chambers 2 to prevent easy detachment of the joint terminal member 4. As a result, the structure of the housing 1 becomes complex.

SUMMARY OF THE INVENTION

It is accordingly a primary object of the present invention to provide an electrical junction device which may reliably retain the joint terminal member in the housing.

It is another object of the present invention to provide an electrical junction device which may eliminate the limitation of the connection timing between the joint terminal member and the terminal of the external wire.

It is a further object of the present invention to provide an electrical junction device which may simplify the structure of the housing.

According to the present invention, there is provided an electrical junction device comprising:

a joint terminal member having an elongate common base, a plurality of terminals extending from the elongate common base to be connected to mating terminals, and a connecting portion formed in the elongate common base at a longitudinal end of the elongate common base to be connected to an external wire;

an electrical insulating housing having a plurality of terminal receiving chambers opening to accommodate the joint terminal member therein and partitioned by partition walls each having a slit to receive the elongate common base therein, the terminal receiving chambers being arranged in a row in correspondence with the plurality of terminals of the joint terminal member;

said electrical insulating housing further having a connecting portion receiving portion formed at a longitudinal end of said row to receive said connecting portion of said joint terminal member; and means to secure said joint terminal member within said terminal receiving chambers of said electrical insulating housing.

With this construction, as the terminal connecting portion is formed by bending the common base of the joint terminal member, the connection between the joint terminal member and the terminal of the external wire can be carried out irrespective of the timing of mounting the electrical junction device to the vehicle or the like. Furthermore, as the common base receiving portion has the bottom wall, the joint terminal member is prevented from being detached from the housing upon insertion of the mating terminal. In connection with this construction, the number of the lances for locking the joint terminal member can be reduced to thereby simplify the structure of the housing.

Other objects and features of the invention will be more fully understood from the following detailed description and appended claims when taken with the accompanying drawings.

DETAILED DESCRIPTION OF THE PREFERRED EMBODIMENTS

Figure 1A:
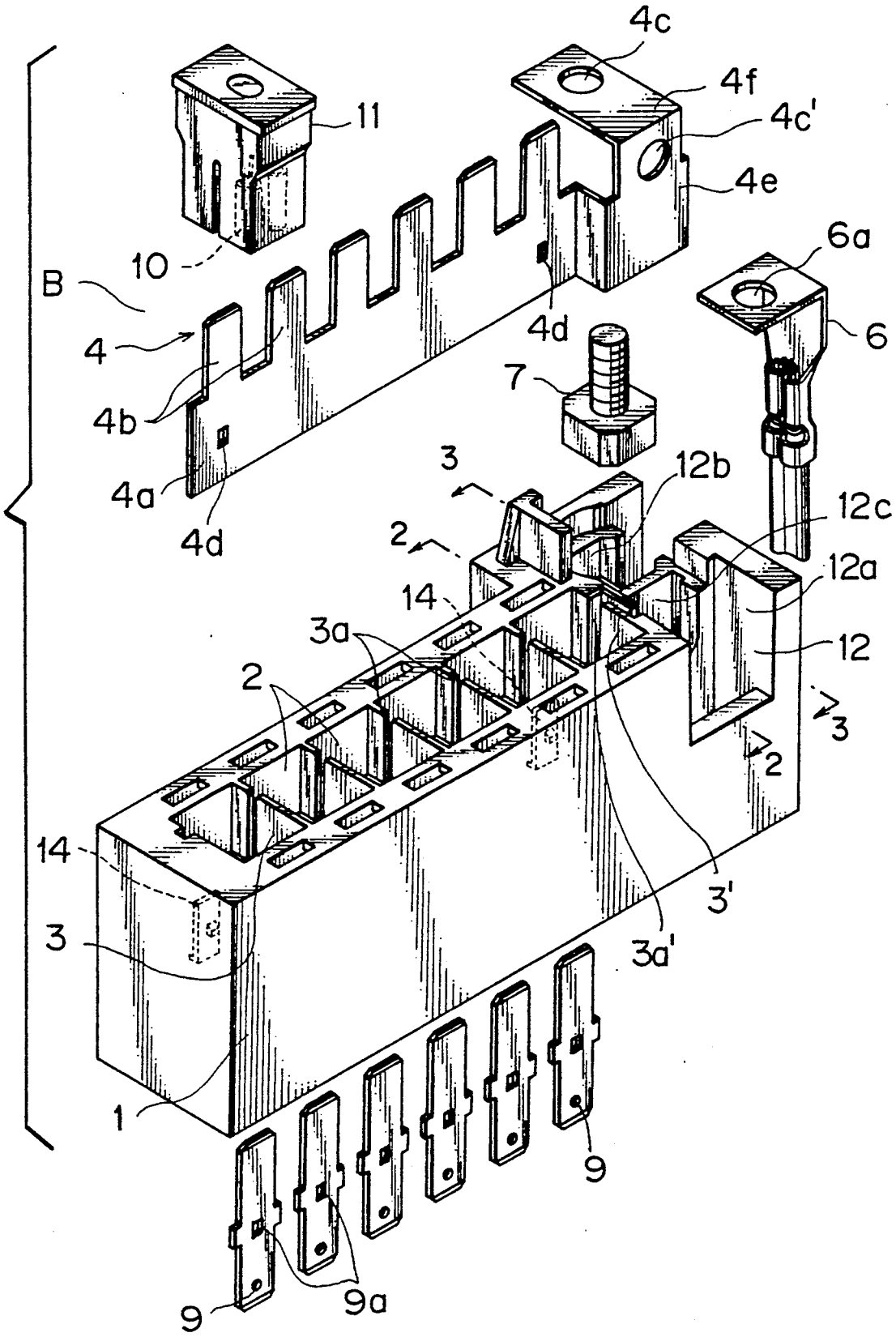
FIG. 1A is an exploded perspective view of a first preferred embodiment of the electrical junction device according to the present invention.
Figure 1B:
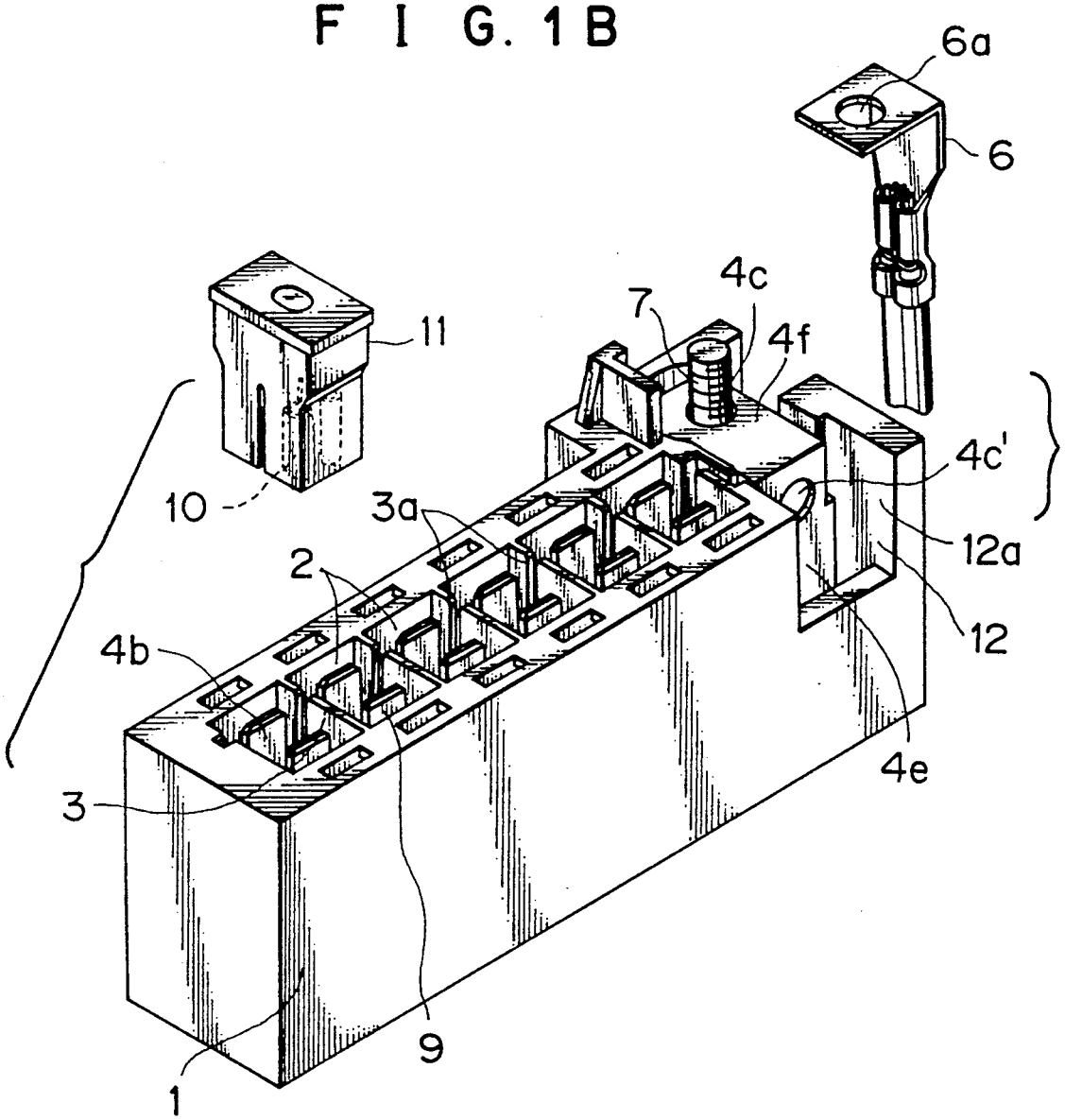
FIG. 1B is a perspective view of the electrical junction device shown in FIG. 1A under the assembled condition.

There will now be described a first preferred embodiment of the present invention with reference to FIGS. 1A to 3B, wherein the same reference numerals as those in FIGS. 8 and 9 denote the same or corresponding parts. Referring to these drawings, a plurality of terminal receiving chambers 2 are partitioned from each other by a plurality of partition walls 3 in an electrical insulating housing 1. A connecting portion receiving chamber 12 having an upper and side opening portion 12*a* is formed at a right end portion of the housing 1 as viewed in FIGS. 1A and 1B. The connecting portion receiving chamber 12 is partitioned from the rightmost terminal receiving chamber 2 by a partition wall 3'. There are defined two bolt receiving portions 12*b* and 12*c* in the connecting portion receiving chamber 12. Each of the partition walls 3 is formed with a slit 3*a* communicating the adjacent terminal receiving chambers 2 with each other. Similarly, the partition wall 3' is formed with a slit 3*a*' communicating the rightmost terminal receiving chamber 2 with the connecting portion receiving chamber 12.

Figure 2:
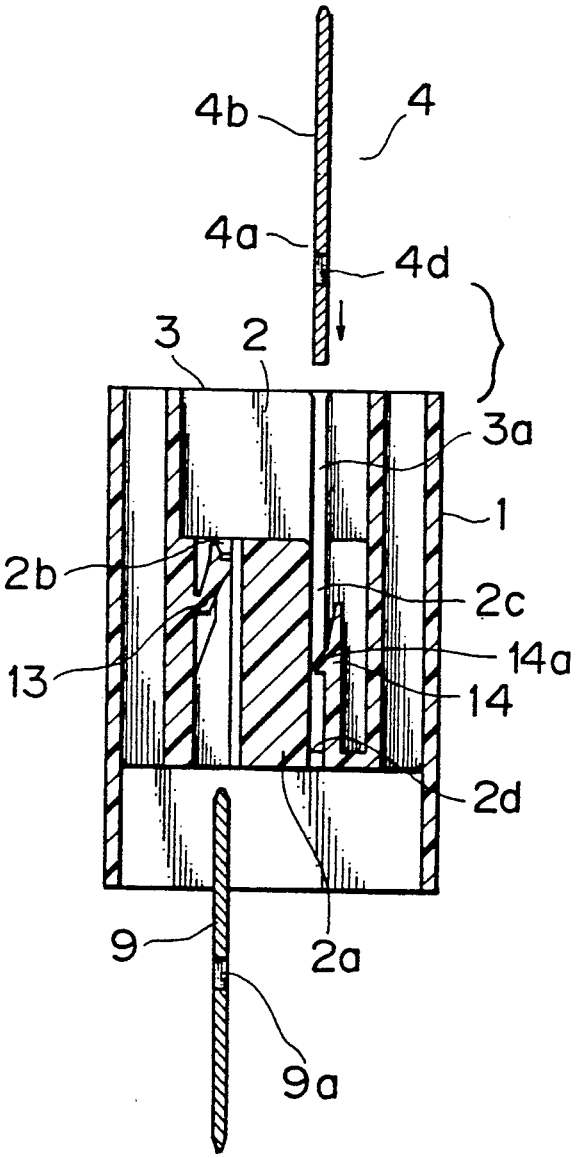
FIG. 2 is a cross section taken along the line 2—2 in FIG. 1.

Referring to FIG. 2, a separating portion 2*a* is formed at a substantially central position in each of the terminal receiving chamber 2. A groove 2*b* for receiving a male terminal 9 is formed on one side of the separating portion 2*a*, and a lance 13 is formed to project into the groove 2*b*. When the male terminal 9 is inserted into the groove 2*b*, a locking end of the lance 13 comes into engagement with a lock hole 9*c* formed through the male terminal 9. On the other side of the separating portion 2*a*, a common base receiving portion 2*c* for receiving a common base 4*a* of a joint terminal member 4 is so formed as to be communicated with the slits 3*a* of the partition walls 3. As shown in FIG. 1A, a pair of lances 14 are formed in the rightmost and leftmost terminal receiving chambers 2 so as to face the common base receiving portions 2*c*. Each of the lances 14 is formed with a locking portion 14*a*, and when the common base 4*a* of the joint terminal member 4 is inserted into the common base receiving portions 2*c*, the locking portions 14*a* of the lances 14 come into engagement with a pair of lock holes 4*d* formed through the common base 4*a*. Thus, it is unnecessary to form the lances 14 in all of the terminal receiving chambers 2. Although the two lances 14 are formed in the rightmost and leftmost terminal receiving chambers 2 in the above preferred embodiment, an additional lance may be formed in the central terminal receiving chamber 2. In the other terminal receiving chambers 2 not formed with the lances 14, the common base receiving portions 2*c* are formed with bottom walls 2*d*.

Figure 8:
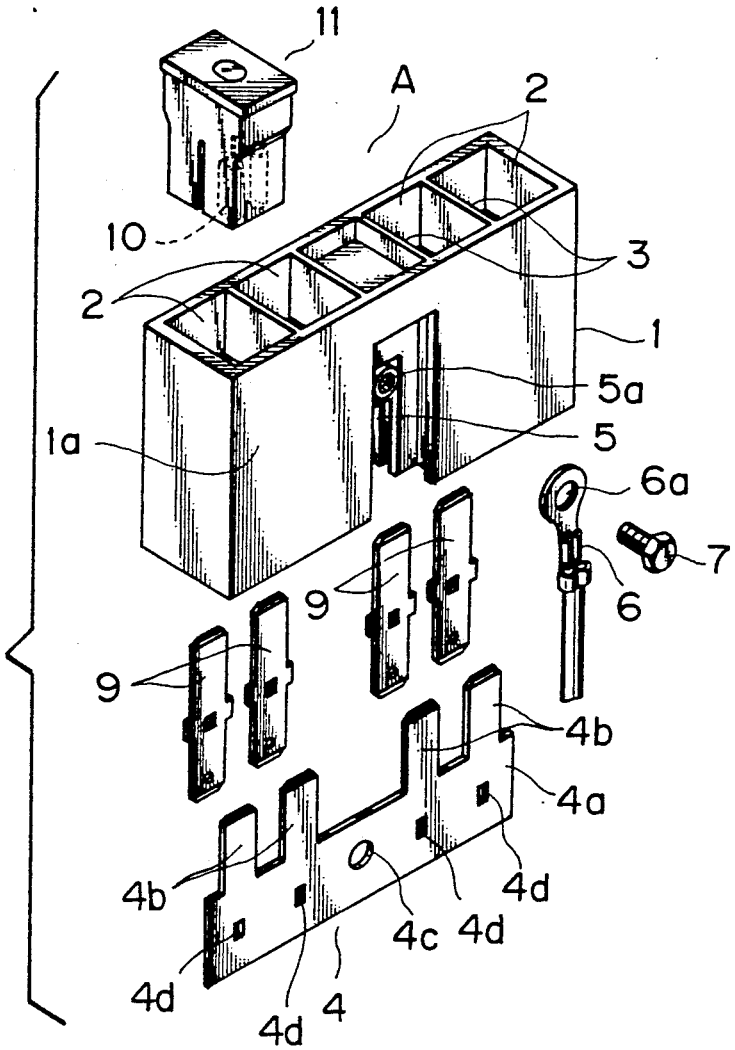
FIG. 8 PRIOR ART
FIG. 8 is an exploded perspective view of the electrical junction device in the prior art.
Figure 9:
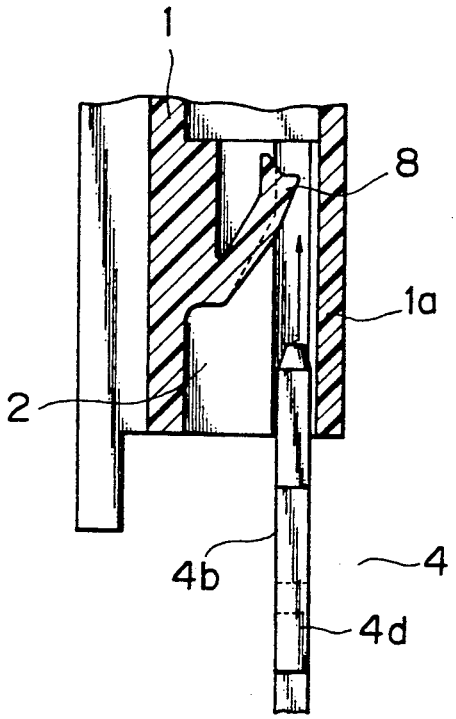
FIG. 9 PRIOR ART
FIG. 9 is a sectional view of an essential part of the locking structure between the housing and the joint terminal member in the prior art.

The joint terminal member 4 has the common base 4*a* and a plurality of tab terminals 4*b* similar to those shown in FIG. 8. However, the common base 4*a* of the joint terminal member 4 according to the present invention is integrally formed at its right end with an extended portion 4*e* bent like a crank from the common base 4*a*. The extended portion 4*e* is further bent at its upper end to form a terminal receiving portion 4*f* extending in perpendicular relationship to the common base 4*a*. The extended portion 4*e* and the connecting portion 4*f* are formed with bolt holes 4*c* and 4*c*', respectively.

The electrical junction device B as constructed above is assembled as follows:

First, the male terminals 9 are inserted into the grooves 2*b* from the lower side of the housing 1 until the locking ends of the lances 13 come into engagement with the locking holes 9*a* of the male terminals 9, thus fixedly mounting the male terminals 9 in the housing 1. Then, female terminals of external wires are connected to the lower ends of the male terminals 9.

Figure 3A:
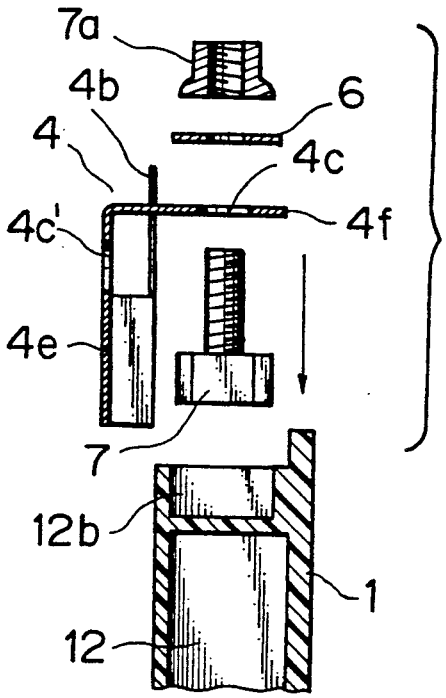
FIG. 3A is a cross section taken along the line 3—3 in FIG. 1.

Then, as shown in FIG. 3A, a head portion of a bolt 7 is fixedly engaged in the bolt receiving portion 12*b* of the connecting portion receiving chamber 12. Although not shown, a threaded portion of another bolt similar to the bolt 7 is inserted into the bolt hole 4*c*' of the extended portion 4*e* of the joint terminal member 4. Then, the joint terminal member 4 is inserted into the housing 1 along the slits 3*a* and 3*a*', and the common base 4*a* is forced into the common base receiving portions 2*c* until it abuts against the bottom walls 2*d* of the common base receiving portions 2*c*. At this time, the locking portions 14*a* of the lances 14 are brought into engagement with the lock holes 4*d* of the joint terminal member 4, thus locking the joint terminal member 4 in the housing 1. During insertion of the joint terminal member 4 into the housing 1, a threaded portion of the bolt 7 fixedly retained in the bolt receiving portion 12*b* is inserted into the bolt hole 4*c* of the connecting portion 4*f*, and simultaneously a head portion of the other bolt inserted into the bolt hole 4*c*' of the extended portion 4*e* is fixedly received into the bolt receiving portion 12*c*.

Figure 3B:
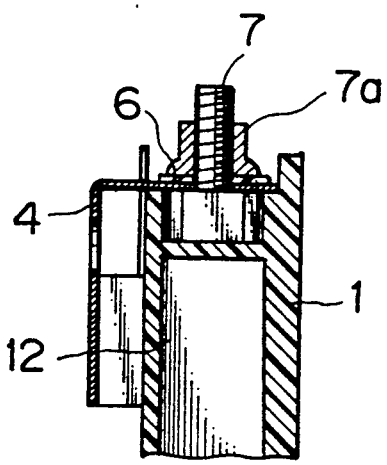
FIG. 3B is a view similar to FIG. 3A, showing the connected condition of the joint terminal member with the terminal of the external wire.

Thereafter, as shown in FIG. 3B, the threaded portion of the bolt 7 is inserted into a bolt hole 6*a* of a terminal 6 of an external wire, and the terminal 6 is connected to the connecting portion 4*f* of the joint terminal member 4 by tightening a nut 7*a* to the bolt 7. Similarly, another nut similar to the nut 7 is tightened to the bolt inserted into the bolt hole 4*c*'. Thus, the joint terminal member 4 is fixedly retained to the housing 1. In modification, both the nuts may be preliminarily inserted into the bolt receiving portions 12*b* and 12*c*, and the bolts may be tightened to the nuts from the outside of the housing 1.

Finally, the fusible link 11 having the female mating terminals 10 is moved in a direction in which the joint terminal member 4 is inserted into the terminal receiving chambers 2 so as to be connected to each pair of the tab terminals 4*b* and the male terminal 9. Thus, the assembly of the electrical junction device B is completed.

According to the above preferred embodiment, the joint terminal member 4 is inserted into the terminal receiving chambers 2 and the connecting portion receiving chamber 12 through the slits 3*a* and 3*a*' and the common base receiving portions 2*c* from the side of the mating terminals 10. Further, the connecting portion 4*f* is formed by bending the common base 4*a* of the joint terminal member 4 in such a manner as to extend in perpendicular relationship to the common base 4*a*. Accordingly, the terminal 6 of the external wire can be easily connected to the joint terminal member 4 irrespective of the timing of mounting the electrical junction device to the vehicle or the like. Furthermore, as the common base receiving portions 2*c* have the bottom walls 2*d*, the joint terminal member 4 is prevented from being detached by the depression of the fusible link 11. In addition, as one surface of the common base 4*a* of the joint terminal member 4 is in surface contact with the side surface of each separating portion 2*a* facing the common base 4*a* in the common base receiving portions 2*c*, a frictional force between both the contact surfaces may be utilized for retention of the joint terminal member 4 in the housing 1. According to the above construction, the number of the lances 14 may be minimized to thereby simplify the structure of the housing 1.

Although the joint terminal member 4 is integrally formed with the tab terminals 4*b* as the male terminals in the above preferred embodiment, the male terminals of the joint terminal member 4 may be replaced by female terminals.

Figure 4:
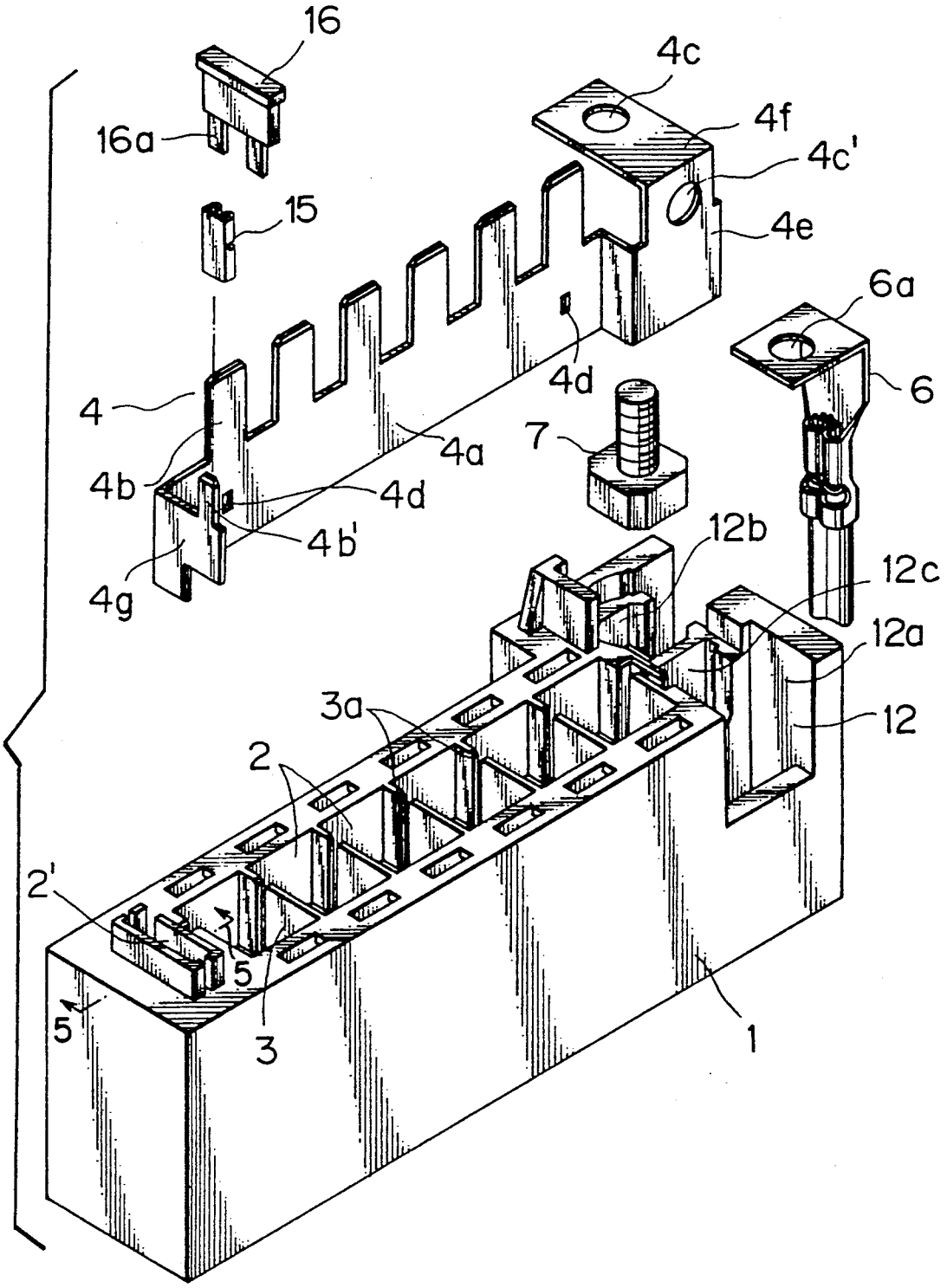
FIG. 4 is an exploded perspective view of a second preferred embodiment of the electrical junction device according to the present invention.
Figure 5:
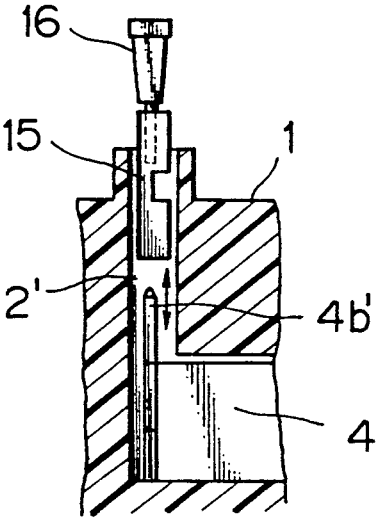
FIG. 5 is a cross section taken along the line 5—5 in FIG. 4.

Referring next to FIG. 4 which shows a second preferred embodiment of the present invention, a male terminal 16*a* of a fuse 16 is connected through a link terminal 15 having opposite female terminal portions to a tab terminal 4*b*' of the joint terminal member 4. The common base 4*a* of the joint terminal member 4 is bent at a left end portion as viewed in FIG. 4 to form a bent portion 4*g*, and the tab terminal 4*b*' extends upwardly from the bent portion 4*g*. The housing 1 is formed at its left end portion as viewed in FIG. 4 with an auxiliary terminal receiving chamber 2' for receiving the bent portion 4*g* with the tab terminal 4*b*'. The other construction is the same as that of the first preferred embodiment, and the explanation thereof will be omitted hereinafter.

The joint terminal member 4 is inserted into the terminal receiving chambers 2 and the auxiliary terminal receiving chamber 2' from the upper side of the housing 1. Then, the link terminal 15 is inserted into the auxiliary terminal receiving chamber 2', and the lower female terminal portion of the link terminal 15 is engaged with the tab terminal 4*b*'. Finally, the male terminal 16*a* of the fuse 16 is engaged with the upper female terminal portion of the link terminal 15.

In removing the fuse 16 connected to the link terminal 15 from the housing 1, there is a possibility that the link terminal 15 will be disengaged from the tab terminal 4*b*' to become missing.

Figure 6:
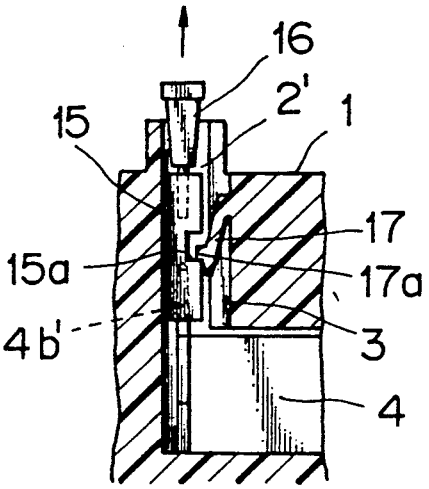
FIG. 6 is a view similar to FIG. 5, showing a modification forming a lance for locking a link terminal at a middle position of an inner wall of the terminal receiving chamber.

FIG. 6 shows a modification of the second preferred embodiment for eliminating the above possibility. Referring to FIG. 6, a lance 17 projects from an inner wall of the auxiliary terminal receiving chamber 2' at a middle position thereof. The lance 17 is formed with a locking portion 17*a* to be engaged with an intermediate recess 15*a* of the link terminal 15. That is, when the link terminal 15 is inserted into the auxiliary terminal receiving chamber 2' from an upper opening thereof, the lance 17 is flexed, and thereafter the intermediate recess 15*a* of the link terminal 15 is brought into engagement with the locking portion 17*a* of the lance 17, thus locking the link terminal 15 in the auxiliary terminal receiving chamber 2'.

With this construction, the fuse 16 only may be removed from the housing 1 with the link terminal 15 retained in the auxiliary terminal receiving chamber 2'. Further, as the mounting of the joint terminal member 4 and the connection of the fuse 16 are carried out from the upper side of the housing, the operation efficiency may be improved.

Figure 7:
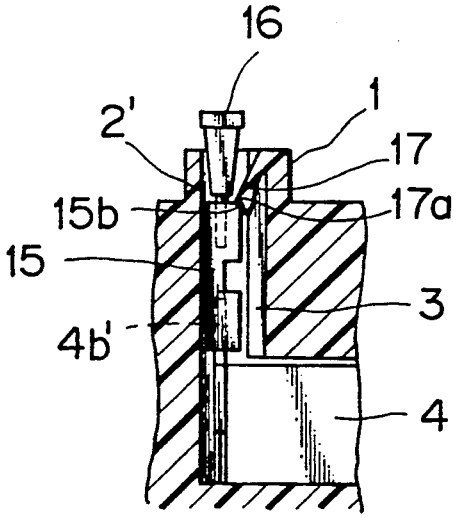
FIG. 7 is a view similar to FIG. 6, showing another modification forming the lance at an upper end of the terminal receiving chamber.

FIG. 7 shows another modification of the above preferred embodiment. Referring to FIG. 7, the lance 17 is formed at an upper end of the auxiliary terminal receiving chamber 2', so that the locking portion 17*a* of the lance 17 may be engaged with an upper end 15*b* of the link terminal 15 to thereby lock the link terminal 15 in the auxiliary terminal receiving chamber 2'.

In a further modification, the lance 17 may be formed on the link terminal 15, and an engaging portion to be locked by the lance 17 may be formed on the inner wall of the auxiliary terminal receiving chamber 2'.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. An electrical junction device comprising:

a joint terminal member having an elongate and vertically extending common base, a plurality of terminals extending vertically from said common base to be connected to mating terminals, and a connecting portion formed integrally with said common base at a longitudinal end thereof and having a first terminal receiving portion extending transversely to the common base and a second terminal receiving portion extending in parallel to the common base to be connected to an external wire;

an electrical insulating housing having a plurality of terminal receiving chambers opening at tops thereof to accommodate said joint terminal member vertically therein and partitioned by partition walls each having a slit to receive said common base vertically therein at the top of the housing, said terminal receiving chambers being arranged in a row in correspondence with said plurality of terminals of said joint terminal member;

said electrical insulating housing provided further with a connecting portion receiving portion formed at a longitudinal end of said row to receive said connecting portion of said joint terminal member, said connecting portion receiving portion having a recess extending vertically thereinto to receive therein a substantial part of fastening means for connecting said first terminal receiving portion to the external wire and another recess extending horizontally thereinto to receive therein a substantial part of fastening means for connecting said second terminal receiving portion to the external wire; and means to secure said joint terminal member within said terminal receiving chambers of said electrical insulating housing when the joint terminal member is insertedly fitted into the housing from its top, securement produced by said means to secure also effecting the fixing of the above-mentioned fastening means to the connecting portion receiving portion via the joint terminal member being fixed to the housing.

2. An electrical junction device according to claim 1, wherein said mating terminals are adapted to be connected to said plurality of terminals by moving in a direction in which said joint terminal member is inserted into said electrically insulating housing, said joint terminal member securing means including bottom walls formed in said terminal receiving chambers.

3. An electrical junction device according to claim 2, wherein said joint terminal member securing means further includes lock holes formed in said common base of said joint terminal member and lances formed in said terminal receiving chambers.

4. An electric junction device according to claim 1, wherein said electrically insulating housing has an auxiliary terminal receiving chamber at another longitudinal end of said row of said terminal receiving chambers, said joint terminal member having a tab terminal adapted to be accommodated in said auxiliary terminal receiving chamber, a link terminal adapted to be inserted in said auxiliary terminal receiving chamber to be connected to said tab terminal, and a fuse adapted to be engaged with said link terminal.

5. An electrical junction device according to claim 4, wherein said auxiliary terminal receiving chamber is formed with means to lock said link terminal therewithin.

* * * * *